US010183518B2

(12) United States Patent
Usami

(10) Patent No.: US 10,183,518 B2
(45) Date of Patent: Jan. 22, 2019

(54) IMAGE FORMING MEDIUM, METHOD FOR PRODUCING IMAGE FORMING MEDIUM, AND IMAGE FORMING METHOD

(71) Applicant: FUJIFILM Corporation, Tokyo (JP)

(72) Inventor: Yoshihisa Usami, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/461,736

(22) Filed: Mar. 17, 2017

(65) Prior Publication Data

US 2017/0190200 A1 Jul. 6, 2017

Related U.S. Application Data

(63) Continuation of application No. PCT/JP2015/072324, filed on Aug. 6, 2015.

(30) Foreign Application Priority Data

Sep. 24, 2014 (JP) ..... 2014-194120

(51) Int. Cl.

| | |
|---|---|
| ***B41M 5/30*** | (2006.01) |
| ***B41M 5/34*** | (2006.01) |
| ***B41M 5/28*** | (2006.01) |
| ***B41J 2/32*** | (2006.01) |
| ***B41J 2/315*** | (2006.01) |

(52) U.S. Cl.

CPC ..... *B41M 5/34* (2013.01); *B41J 2/315* (2013.01); *B41J 2/32* (2013.01); *B41M 5/28* (2013.01); *B41M 5/30* (2013.01); *B41M 2205/04* (2013.01)

(58) Field of Classification Search

CPC ..... B41M 5/30; B41M 2205/04

USPC ..... 503/200, 201, 226; 427/150–152; 428/150

See application file for complete search history.

(56) References Cited

U.S. PATENT DOCUMENTS

| | | | |
|---|---|---|---|
| 3,312,979 | A | 4/1967 | Della Torre et al. |
| 3,466,423 | A | 9/1969 | Janning |
| 3,975,707 | A | 8/1976 | Ito et al. |

FOREIGN PATENT DOCUMENTS

| | | | |
|---|---|---|---|
| JP | S56-97383 | A | 8/1981 |
| JP | H02-39189 | A | 2/1990 |

(Continued)

OTHER PUBLICATIONS

International Preliminary Report on Patentability (IPRP) dated Mar. 28, 2017, from corresponding PCT/JP2015/072324, 6 pp.

(Continued)

*Primary Examiner* — Bruce H Hess

(74) *Attorney, Agent, or Firm* — Studebaker & Brackett PC

(57) ABSTRACT

An image forming medium capable of forming an image without using a printer including a plurality of first metal electrodes extending in one direction and being parallel to one another, a first oxide layer in which the first metal electrodes are embedded and which is made of an oxide of a metal constituting the first metal electrodes, a plurality of second metal electrodes extending in one direction and crossing the first electrodes in a surface direction of the first oxide layer, a second oxide layer in which the second metal electrodes are embedded and which is made of an oxide of a metal constituting the second metal electrodes, and a thermal color developing layer provided on the first metal electrodes or the second metal electrodes, in which the second metal electrodes are separated from the first metal electrodes by the second oxide layer.

15 Claims, 4 Drawing Sheets

(56) References Cited

FOREIGN PATENT DOCUMENTS

| | | | |
|---|---|---|---|
| JP | H05-37126 | A | 2/1993 |
| JP | H05-278332 | A | 10/1993 |
| JP | H06-206324 | A | 7/1994 |
| JP | H08-510067 | A | 10/1996 |
| JP | 2012-104639 | A | 5/2012 |

OTHER PUBLICATIONS

International Search Report issued in PCT/JP2015/072324; dated Sep. 8, 2015.
Written Opinion issued in PCT/JP2015/072324; dated Sep. 8, 2015.
The extended European search report issued by the European Patent Office dated Aug. 22, 2017, which corresponds to European Patent Application No. 15843461.3-1701 and is related to U.S. Appl. No. 15/461,736.

IMAGE FORMING MEDIUM, METHOD FOR PRODUCING IMAGE FORMING MEDIUM, AND IMAGE FORMING METHOD

CROSS-REFERENCE TO RELATED APPLICATIONS

This application is a Continuation of PCT International Application No. PCT/JP2015/072324 filed on Aug. 6, 2015, which claims priority under 35 U.S.C. § 119(a) to Japanese Patent Application No. 2014-194120 filed on Sep. 24, 2014. The above application is hereby expressly incorporated by reference, in its entirety, into the present application.

BACKGROUND OF THE INVENTION

1. Field of the Invention

The present invention relates to an image forming medium capable of forming an image supplied from a smartphone or the like without using an image forming apparatus, a method for producing the image forming medium, and an image forming method using the image forming medium.

2. Description of the Related Art

There are various methods for image formation to obtain a print (hard copy).

For example, in silver halide photography, an image is formed by exposing a photosensitive material (photo film or photographic printing paper), which is sensitive to light of red (R), green (G), and blue (B) to develop colors of cyan (C), magenta (M), and yellow (Y), to light and carrying out a development treatment. For the exposure method, methods of projection, scanning exposure using a laser beam, and the like may be used.

In an ink jet method, an image is formed by jetting ink droplets to an image receiving medium such as paper by an ink jet head which jets ink droplets of C, M, and Y or further black (B) according to an image to be formed.

In a thermosensitive sublimation film, a thermosensitive sublimation film having dyes of C, M, and Y having thermosensitive sublimation properties is heated by a thermal head according to an image to be formed and the sublimated dyes are transferred onto image receiving paper to form an image.

In addition, an image forming method including heating a thermal film having dyes of C, M, and Y to be color-developed by heating, by a thermal head or an exposure head for heating according to an image to be formed and developing the colors of the dyes of the thermal film is also known.

According to these image forming methods, it is possible to store the formed image as a print for a long period of time. However, in any of these methods, an image forming apparatus (printer) is required.

For example, in image formation by silver halide photography, a photo printer having an exposure device for exposing a photosensitive material to light according to an image to be formed and a development device for carrying out a wet development treatment, such as development, bleaching, and fixing, on the exposed photosensitive material is required.

In addition, in image formation by an ink jet method, an ink jet printer having an ink jet head for jetting ink droplets, moving means for relatively moving the ink jet head and an image receiving medium, and the like is required.

Further, in image formation using a thermosensitive sublimation film and a thermal film, a thermal printer having a thermal head or an exposure head for heating exposure, moving means for relatively moving the head and a film, and the like is required. The exposure head for heating exposure is a so-called thermal mode exposure head.

In contrast, image forming mediums which do not require an image forming apparatus are disclosed in JP1993-278332A (JP-H05-278332A) and JP1996-510067A (JP-H08-510067A).

The image forming mediums disclosed in these documents are configured to include a x-y matrix electrode composed of a plurality of x electrodes which extend in an x direction and a plurality of y electrodes which extend in a y direction perpendicular to the x direction, a heat generating resistor which is disposed between the matrix electrodes, and a thermal recording layer which is provided on one electrode of the matrix electrode.

In such an image forming medium, the intersection of the x electrode and the y electrode in the matrix electrode is a pixel for forming an image.

In the image forming medium, according to an image supplied from a personal computer, a smartphone, or the like, the heat generating resistor is heated at the intersection of the both electrodes by applying a current to the x electrode and the y electrode corresponding to a pixel to be color-developed and the thermal recording layer is color-developed by the heat so as to form an image.

SUMMARY OF THE INVENTION

According to the image forming mediums disclosed in JP1993-278332A (JP-H05-278332A) and JP1996-510067A (JP-H08-510067A), it is possible to form an image without using an image forming apparatus having a recording head, such as a thermal head and an ink jet head, moving means for relatively moving an image forming medium and the recording head, and the like.

However, labor and costs for forming a matrix electrode in these image forming mediums are required. Further, it is difficult to obtain a high definition image in these image forming mediums.

An object of the present invention is to solve the above problems and to provide an image forming medium which is capable of forming an image without using an image forming apparatus having a recording head, moving means for relatively moving the recording head and an image forming medium, and the like, also can be easily produced at a low cost, and facilitates formation of a high definition image.

In order to achieve such an object, there is provided an image forming medium according to the present invention comprising:

a plurality of first metal electrodes which extend in one direction and are parallel to one another;

a first oxide layer in which the first metal electrodes are embedded and which is made of an oxide of a metal constituting the first metal electrodes;

a plurality of second metal electrodes which extend in one direction, are parallel to one another, and cross the first electrodes in a surface direction of the first oxide layer;

a second oxide layer in which the second metal electrodes are embedded and which is made of an oxide of a metal constituting the second metal electrodes; and a thermal color developing layer which is provided on the first metal electrodes or the second metal electrodes, in which the second metal electrodes are separated from the first metal electrodes by the second oxide layer.

In the image forming medium according to the present invention, it is preferable that, out of the first metal electrode and the second metal electrode, a metal electrode on which the thermal color developing layer is provided is thicker than the other metal electrode.

It is preferable that the thermal color developing layer is provided to be in direct contact with the first metal electrodes or the second metal electrodes.

It is preferable that the first oxide layer and the second oxide layer forms a single oxide layer, and the first metal electrodes are embedded in one surface of the single oxide layer and the second metal electrodes are embedded in a surface of the single oxide layer on the opposite side of the surface in which the first metal electrodes are embedded.

It is preferable that a resistance value of the second oxide layer is 2 to 1,000,000 times resistance values of the first metal electrode and the second metal electrode.

It is preferable that a thickness of the second oxide layer at a region between the first metal electrode and the second metal electrode is 0.01 to 1,000 μm.

It is preferable that a thickness of the second oxide layer is 0.02 to 2,000 μm.

It is preferable that a resistance value of one metal electrode of the first metal electrode and the second metal electrode is 0.5 to 2 times a resistance value of the other metal electrode.

According to a first aspect of the present invention, there is provided a method for producing an image forming medium comprising: a step of forming a plurality of first metal electrodes, which extend in one direction and are parallel to one another, on one surface of a first oxide layer made of a metal oxide by reducing the metal oxide;

a step of forming a second oxide layer, which is made of a metal oxide, on the surface of the first oxide layer on which the first metal electrodes are formed;

a step of forming a plurality of second metal electrodes, which extend in one direction, are parallel to one another, and cross the first electrodes in a surface direction of the second oxide layer, on a surface of the second oxide layer by reducing the metal oxide; and a step of providing a thermal color developing layer on the surface of the first oxide layer or the second oxide layer.

In the first aspect of the method for producing an image forming medium according to the present invention, it is preferable that the thermal color developing layer is provided on the surface of the second oxide layer.

In addition, it is preferable that the metal oxide is reduced by irradiation with light.

In addition, it is preferable that in the formation of the first metal electrodes and the second metal electrodes, a metal electrode on the side close to the thermal color developing layer is formed to be thicker than the other metal electrode.

According to a second aspect of the present invention, there is provided a method for producing an image forming medium comprising: a step of forming a plurality of first metal electrodes, which extend in one direction and are parallel to one another, on one surface of an oxide layer made of a metal oxide by reducing the metal oxide;

a step of forming a plurality of second metal electrodes, which extend in one direction, are parallel to one another, and cross the first electrodes in a surface direction of the oxide layer, on a surface of the oxide layer on the opposite side of the surface on which the first metal electrodes are formed by reducing the metal oxide; and a step of providing a thermal color developing layer on one surface of the oxide layer.

In the method for producing an image forming medium according to the present invention, it is preferable that the metal oxide is reduced by irradiation with light.

In addition, it is preferable that in the formation of the first metal electrodes and the second metal electrodes, a metal electrode on the side close to the thermal color developing layer is formed to be thicker than the other metal electrode.

An image forming method according to the present invention provides an image forming method comprising: sequentially applying a current to the first metal electrodes and the second metal electrodes of the image forming medium according to the present invention based on an image to be formed and generating heat at regions between the first metal electrodes and the second metal electrodes in the second oxide layer to color-develop the thermal color developing layer.

According to the image forming medium of the present invention, since an image is formed only by applying a current to first metal electrodes and second metal electrodes according to an image supplied from an image supply source such as a personal computer or a smartphone, it is possible to form an image without using an image forming apparatus having a recording head, moving means for relatively moving an image forming medium and the recording head, and the like.

In addition, the image forming medium of the present invention can be easily produced at a low cost and achieve high definition since a metal oxide is used as a heat generating layer and the first metal electrodes and the second metal electrodes can be formed by reducing the metal oxide, which become a heat generating layer, by light beam scanning or the like.

DESCRIPTION OF THE PREFERRED EMBODIMENTS

Hereinafter, an image forming medium and a method for producing an image forming medium and furthermore, an image forming method according to the present invention will be described in detail based on preferable embodiments shown in the attached drawings.

Figure 1:
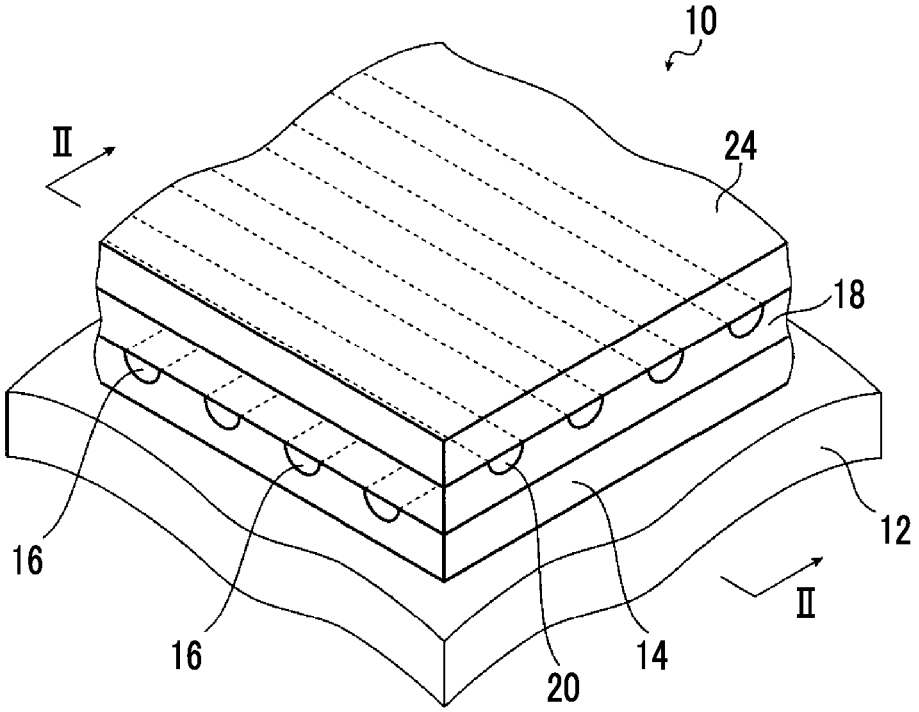
FIG. 1 is a schematic perspective view for illustrating an example of an image forming medium according to the present invention.
Figure 2:
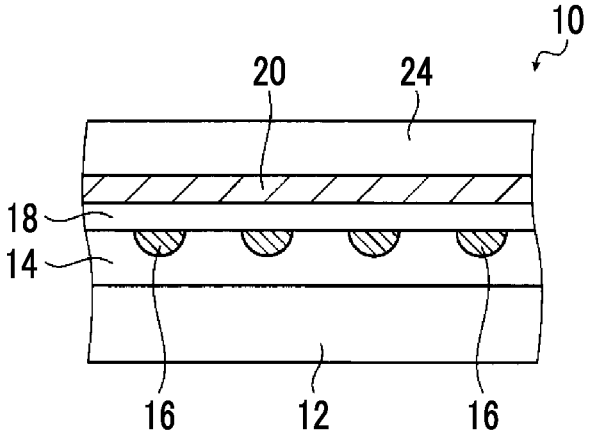
FIG. 2 is a cross-sectional view taken along line II-II of FIG. 1.
Figure 3:
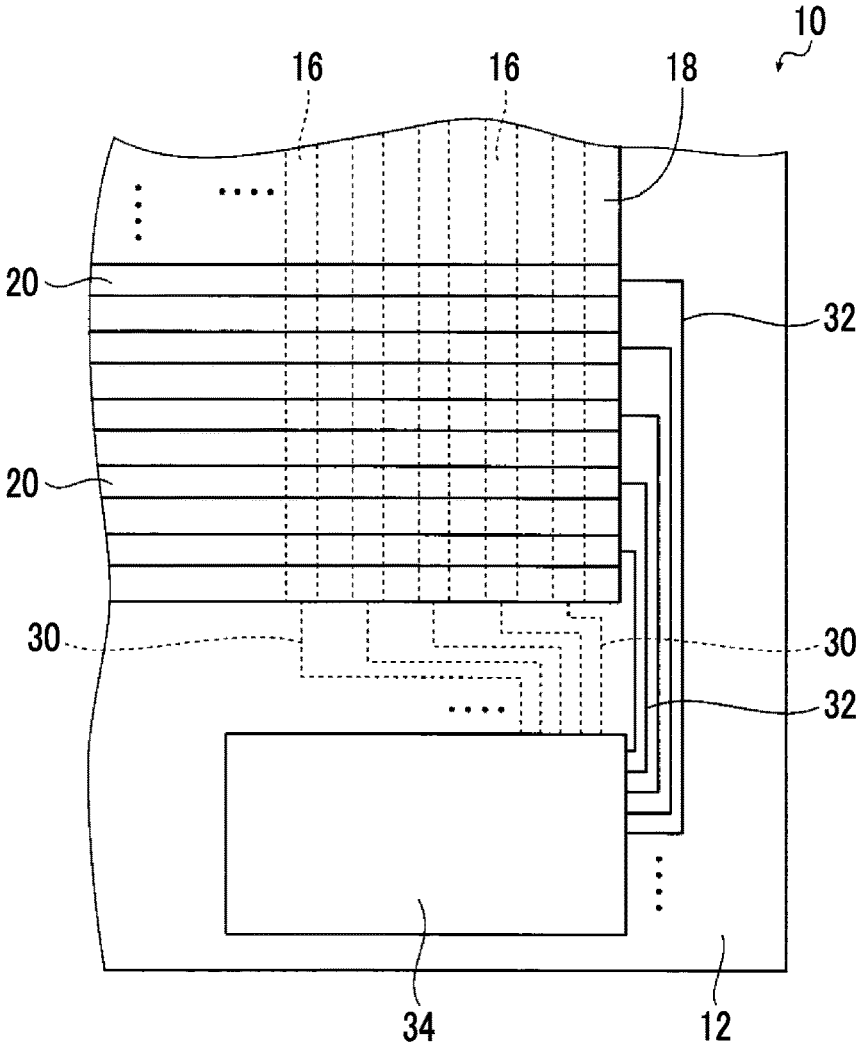
FIG. 3 is a schematic top view showing the example of the image forming medium according to the present invention.

FIG. 1 is a schematic perspective view for illustrating an example of an image forming medium according to the present invention, FIG. 2 is a cross-sectional view taken along line II-II of FIG. 1, and FIG. 3 is a schematic top view showing the image forming medium in FIG. 1, respectively. The top view of FIG. 3 is a view when the image forming medium of the present invention is seen from the upper direction of FIGS. 1 and 2.

An image forming medium 10 shown in FIGS. 1 to 3 is configured to basically have a substrate 12, a first oxide layer 14, first metal electrodes 16, a second oxide layer 18, second metal electrodes 20, and a thermal color developing layer 24.

As shown in FIG. 3, wirings 30 and 32, and a control unit 34 are provided on the substrate 12. The first metal electrodes 16 of the image forming medium 10 are connected to the control unit 34 through the wirings 30 and the second metal electrodes 20 are connected to the control unit through the wirings 32. In FIG. 3, in order to clearly show the configuration of the image forming medium 10, the thermal color developing layer 24 is omitted.

In the present invention, the expression "parallel to one another" means that the long axial directions are directed to the same direction. However, the long axial directions may not be completely parallel with one another and the expression "parallel to one another" means that the long axial directions do not cross within a range of wirings thereof.

In addition, the expression "cross" means that the angles of the long axial directions are different and includes not only crossing at right angles but also crossing at oblique angles.

[Substrate]

The substrate 12 is a support substrate for supporting the entire image forming medium 10.

In the image forming medium 10 of the present invention, the substrate 12 can support the first oxide layer 14 and the like, and as long as the control unit 34 and the wirings 30 and 32 can be formed, various sheet-like materials (plate-like materials/film-like materials) can be used.

Examples thereof include films or plates made of resin materials such as engineering plastics using polyimide, amorphous polyolefin, polyesters such as polyethylene terephthalate (PET) and polyethylene naphthalate (PEN), ionomers, polyethylene, polyvinyl chloride, polyvinylidene chloride, polyvinyl alcohol, polypropylene, polycarbonate, polystyrene, polyacrylonitrile, ethylene-vinyl acetate copolymers, ethylene-vinyl alcohol copolymers, ethylene-methacrylic acid copolymers, nylon, polyamide, cellophane, and liquid crystals, films using celluloses such as triacetyl cellulose and cellulose nanofibers, films made of resins mixed with carbon nanofibers and glass fibers, and sheets using thin glass and paper.

Among these, films made of polyimide, PET, PEN, amorphous polyolefin, and polycarbonate, and the like can be suitably used.

The thickness of the substrate 12 may be set to be appropriate according to the size of the image forming medium 10, required flexibility, and the like.

According to the investigation of the present inventors, the thickness of the substrate 12 is preferably 0.01 to 5 mm and more preferably 0.1 to 1 mm.

It is preferable that the thickness of the substrate 12 is set to 0.01 mm or more from the viewpoint of being capable of obtaining an image forming medium 10 having good strength to hardly cause crumpling of the image forming medium at the time of handling, reducing an influence on chemical and physical external disturbances from the rear surface, and the like.

In addition, it is preferable that the thickness of the substrate 12 is set to 5 mm or less from the viewpoint of being capable of obtaining an image forming medium 10 having good flexibility, achieving good applicability to an apparatus for carrying out coating or printing, and the like.

[First Oxide Layer]

The first oxide layer 14 is formed on the substrate 12.

The first oxide layer 14 is a layer made of a metal oxide and is a layer made of an oxide of a metal for forming the first metal electrodes 16, which will be described later. Accordingly, for the forming material, oxides of metals used for the first metal electrodes 16 may be suitably used.

The thickness of the first oxide layer 14 is may be set to an appropriate thickness according to the size and thickness of the image forming medium 10 such that the first metal electrode 16 having a sufficient thickness can be embedded.

According to the investigation of the present inventors, the thickness of the first oxide layer 14 is preferably 0.01 to 1,000 μm and more preferably 0.1 to 100 μm.

It is preferable that the thickness of the first oxide layer 14 is set to 0.01 μm or more from the viewpoint of being capable of obtaining low resistance suitable for realizing a circuit function when the first metal electrodes 16 are formed by metallization, which will be described later and the like.

In addition, it is preferable that the thickness of the first oxide layer 14 is set to 1,000 μm or less from the viewpoint of being capable of obtaining an image forming medium 10 having good flexibility and the like.

The first metal electrodes 16 are embedded in the first oxide layer 14 such that the first metal electrodes are partially exposed at the surface of the first oxide layer 14. The first metal electrodes 16 are partially exposed at the surface of the first oxide layer 14 on the side close to the second oxide layer 18.

The detailed description of the first metal electrodes 16 will be made later.

[Second Oxide Layer (Heat Generating Layer)]

The second oxide layer 18 is formed on the first oxide layer 14. The second oxide layer 18 is a layer made of a metal oxide and is a layer made of an oxide of a metal for forming the second metal electrodes 20, which will be described later. Accordingly, for the forming material, oxides of metals used for the second metal electrodes 20 may be suitably used.

The second oxide layer 18 is made of a metal oxide. Accordingly, heat is generated by applying a current. In the image forming medium 10 shown in the drawing, a region between the first metal electrode 16 and the second metal electrode 20 in the second oxide layer 18 functions as a heat generating layer (heat generating resistance layer). In other words, in the image forming medium 10, a region of the second oxide layer 18 closer to first oxide layer 14 than to the second metal electrode 20 in the thickness direction functions as a heat generating layer.

Here, the material for forming the second oxide layer 18 which functions as a heat generating layer preferably has the ability to reach a required temperature with low energy. Regarding this point, the same will be applied to the material for forming a metal oxide layer 42, which will be described later.

The amount of heat generated is determined by "voltage x current" and the current is determined by "voltage/resistance". Accordingly, the amount of heat generated is determined by "voltage$^2$/resistance". That is, the lower the resistance value of the second oxide layer 18 is, the more preferable it is. However, when the resistance value of the second oxide layer 18 is lower than the resistance values of the first metal electrode 16 and the second metal electrode 20, heat is generated in the first metal electrode 16 and the like.

Considering this point, the resistance value of the second oxide layer 18 which functions as a heat generating layer is preferably two times or more, more preferably five times or more, and particularly preferable ten times or more of the resistance values (wiring resistance) of the first metal electrode 16 and the second metal electrode 20.

In contrast, when the resistance value of the second oxide layer 18 which functions as a heat generating layer is too high, a high voltage is required for heat generation and costs for image formation increases, thereby increasing a possibility of causing dielectric breakdown.

Considering this point, the resistance value of the second oxide layer 18 is preferably 1,000,000 times or less, more preferably 100,000 times or less, and particularly preferably 10,000 times or less of the resistance values of the first metal electrode 16 and the second metal electrode 20.

When the resistance value of the second oxide layer 18 is less than two times the resistance values of the first metal electrode 16 and the second metal electrode 20, sufficient heat generation may not be obtained and heat is generated in the first metal electrode 16 and the like in some cases. In contrast, when the resistance value of the second oxide layer 18 is greater than 1,000,000 times the resistance values of the first metal electrode 16 and the second metal electrode 20, heat is not generated even when a high voltage is applied and power consumption increases, thereby increasing a possibility of causing dielectric breakdown.

The thickness of the second oxide layer 18 may be set to be appropriate such that the second metal electrode 20 having a sufficient thickness, which will be described later, can be embedded and a region closer to the first oxide layer 14 than to the second metal electrode 20 which functions as a heat generating layer can function as a heat generating layer.

Although described later, in the image forming medium 10 of the present invention, the thickness of the heat generating layer is preferably 0.01 to 1,000 μm and the thickness of the second metal electrode 20 is preferably 0.01 to 1,000 μm.

Accordingly, the thickness of the second oxide layer 18 is preferably 0.02 to 2,000 μm.

The second metal electrodes 20 which are partially exposed at the surface of the second oxide layer 18 are embedded in the second oxide layer 18. The second metal electrodes 20 are partially exposed at the surface of the second oxide layer 18 on the side close to the thermal color developing layer 24.

The detailed description of the second metal electrodes 20 will be made later.

[Thermal Color Developing Layer]

The thermal color developing layer 24 is provided on the second oxide layer 18. The expression "on the second oxide layer 18" refers to on the second metal electrode 20.

The thermal color developing layer 24 is a layer for carrying out color development by heating. For the thermal color developing layer 24 in the image forming medium 10 of the present invention, various known sheet-like materials (film-like materials), such as thermal paper (thermal recording paper), a thermal film (thermal recording film), a sublimation transfer film, a heat transfer film, and the like, capable of carrying out color development by heating to form an image (visible image) can be used.

In addition, the thermal color developing layer 24 may be formed by applying a paint obtained by dispersing a known pigment which develops color by heating to the second oxide layer 18 and drying the paint.

In addition, the thermal color developing layer 24 develops color preferably at 80° C. to 800° C., more preferably at 100° C. to 400° C., and particularly preferably at 120° C. to 250° C.

It is preferable that the color development temperature of the thermal color developing layer 24 is set to 80° C. or higher from the viewpoint of being capable of improving the storage stability of the image forming medium 10 by preventing color development at room temperature, and the like. It is preferable that the color development temperature of the thermal color developing layer 24 is set to 800° C. or lower from the viewpoint of being capable of reducing an amount of energy required for image formation and preventing deterioration in image quality by damaging the substrate 12 or the like at the time of image formation.

In the image forming medium 10 shown in the drawing, the thermal color developing layer 24 is provided on the second oxide layer 18 at which the second metal electrode 20 is exposed. That is, the thermal color developing layer 24 is in direct contact with the metal electrode.

The image forming medium of the present invention may adopt, for example, a configuration in which the substrate 12 and the thermal color developing layer 24 are exchanged, in addition to this configuration.

However, in order to improve the color development efficiency of the thermal color developing layer 24, as shown in drawing, the thermal color developing layer 24 is preferably in direct contact with the metal electrode.

Further, the thermal color developing layer 24 may be peelable.

When the thermal color developing layer is peelable, the image forming medium 10 can be recycled by peeling off the thermal color developing layer 24 on which an image is formed and providing a new thermal color developing layer 24.

[First Metal Electrode and Second Metal Electrode]

As described above, the plurality of first metal electrodes 16 are embedded in the first oxide layer 14 such that the first metal electrodes are partially exposed at the surface of the first oxide layer 14.

On the other hand, the plurality of second metal electrodes 20 are embedded in the second oxide layer 18 which is formed on the first oxide layer 14 such that the second metal electrodes are partially exposed at the surface of the second oxide layer 18.

The first metal electrodes 16 extend in one direction and are arranged at predetermined intervals in a direction perpendicular to the extending direction. The first metal electrode 16 extends in a direction vertical to the paper surface in FIG. 2.

On the other hand, the second metal electrodes 20 extend in a direction in which the first metal electrodes 16 are arranged and are arranged at predetermined intervals in the extending direction of the first metal electrodes 16. In other words, the second metal electrodes 20 extend in a direction perpendicular to the extending direction of the first metal electrodes 16 and are arranged at predetermined intervals in a direction perpendicular to the extending direction thereof.

That is, the first metal electrodes 16 and the second metal electrodes 20 have a region of the second oxide layer 18 close to the first oxide layer 14 than to the second metal electrode 20 interposed therebetween and forms a x-y matrix electrode in which the metal electrodes cross one another as shown in FIG. 3.

In addition, in the image forming medium 10, an intersection of the first metal electrode 16 and the second metal electrode 20 is a pixel which forms an image.

Further, the region between the first metal electrode 16 and the second metal electrode 20 in the second oxide layer 18 functions as a heat generating layer.

In the image forming medium 10 of the present invention, by applying a current to the first metal electrode 16 and the second metal electrode 20, the current flows at an intersection of the first metal electrode 16 and the second metal electrode 20, that is, a pixel, in the second oxide layer 18 between the first metal electrode 16 and the second metal electrode 20.

The second oxide layer 18 is a metal oxide and generates heat by applying a current. The heat is propagated by the second metal electrode 20 and the thermal color developing layer 24 is heated. Thus, the thermal color developing layer 24 at a position corresponding to the intersection of the first metal electrode 16 and the second metal electrode 20 develops color.

Therefore, according to the image forming medium 10 of the present invention, it is possible to prepare a print (hard copy) having a visible image formed thereon by forming an image without using an image forming apparatus (printer) having a recording head and the like, for example, by sequentially applying a current to the first metal electrode 16 and the second metal electrode 20 corresponding to a pixel which forms an image according to an image to be formed by the image forming method of the present invention.

Although described later, according to the present invention, since the highly refined first metal electrode 16 and second metal electrode 20 can be formed, a high definition image can be formed with high accuracy.

In the image forming medium 10 shown in FIG. 1, the first metal electrode 16 and the second metal electrode 20 are formed to be perpendicular to each other in the surface direction of the second oxide layer 18. However, the present invention can adopt various configurations, in addition to this configuration.

For example, the first metal electrode 16 may cross the second metal electrode 20 at an angle of 45° or the first metal electrode 16 may cross the second metal electrode 20 at an angle of 30°.

That is, the present invention can adopt various configurations as long as the first metal electrodes 16 are parallel to one another and the second metal electrodes 20 are parallel to one another, and further, the first metal electrodes 16 and the second metal electrodes 20 cross one another in the surface direction of the second oxide layer 18 to form a matrix electrode. The surface direction of the second oxide layer 18 refers to a surface direction of the first oxide layer 16 and the substrate 12.

In the present invention, a case in which the first metal electrodes 16 are not parallel to one another but do not cross one another in the surface direction of the second oxide layer 18 is considered as being parallel. Regarding this point, the same will applied to the second metal electrodes 20.

For the materials for forming the first metal electrode 16 and the second metal electrode 20, various metals that can form oxides can be used.

Specific examples thereof include copper, silver, chromium, zinc, tin, aluminum, nickel, cobalt, platinum, lead, gold, iron, magnesium and the like. Among these, from the viewpoint of ease of availability of metals and oxides thereof at a low cost and the like, copper silver, chromium, zinc, tin, aluminum, nickel, cobalt and the like may be suitably used. Among these, from the viewpoint of stability, copper, silver, nickel, cobalt and the like are particularly suitably used.

The materials for forming the first metal electrode 16 and the second metal electrode 20 may be the same or different from each other. That is, the materials for forming the first oxide layer 14 and the second oxide layer 18 may be the same or different from each other.

The thickness of the first metal electrode 16 and the second metal electrode 20 may be set to be appropriate according to the size and the thickness of the image forming medium 10, the formation interval between the metal electrodes, and the like.

According to the investigation of the present inventors, the thickness of the first metal electrode 16 and the second metal electrode 20 is preferably 0.001 to 1,000 μm, more preferably 0.01 to 100 μm, and still more preferably 0.1 to 10 μm.

It is preferable that the thickness of the first metal electrode 16 and the second metal electrode 20 is set to 0.001 μm or more from the viewpoint of being capable of suitably preventing disconnection, obtaining low resistance for circuit properties, and the like.

In addition, it is preferable that the thickness of the first metal electrode 16 and the second metal electrode 20 is set to 1,000 μm or less from the viewpoint of obtaining an image forming medium having good flexibility and the like.

Here, in the image forming medium 10 (image forming medium 40), the thickness of the second metal electrode 20 is a distance between the heat generating layer and the thermal color developing layer 24.

When the distance between the heat generating layer and the thermal color developing layer 24 is too long, effective image formation heat cannot be carried out due to heat release. Considering this point, the distance between the heat generating layer and the thermal color developing layer 24 is preferably 1,000 μm or less, more preferably 100 μm or less, and particularly preferably 10 μm or less.

In addition, when the distance between the heat generating layer and the thermal color developing layer 24 is too short, the thermal color developing layer 24 is modified with a component from an oxide to deteriorate storage stability. Considering this point, the distance between the heat generating layer and the thermal color developing layer 24 is preferably 0.001 μm or more, more preferably 0.01 μm or more, and particularly preferably 0.1 μm or more.

It is preferable that an insulating material such as resin is inserted between the heat generating layer and the thermal color developing layer 24, between the heat generating layer and the second metal electrode 20, between the second metal electrode 20 and the thermal color developing layer 24. By inserting the insulating material between the heat generating layer and the thermal color developing layer 24, it is possible to prevent the thermal color developing layer 24 from being modified with a component from an oxide to deteriorate storage stability. By inserting the insulating material between the heat generating layer and the second metal electrode 20, a chemical interaction between the heat generating layer and the second metal electrode 20 can be suppressed. Further, by inserting the insulating material between the second metal electrode 20 and the thermal color developing layer 24, the second metal electrode 20 can be prevented from deterioration such as oxidization.

As shown in FIGS. 1 and 2, in the case in which the thickness of the first metal electrode 16 and the second metal electrode 20 is not uniform, the thickness of the first metal electrode 16 and the second metal electrode 20 is a thickness at a position with the maximum thickness.

The resistance values of the first metal electrode 16 and the second metal electrode 20 preferably reach the same degree. Specifically, regarding the resistance values of the first metal electrode 16 and the second metal electrode 20, it is preferable that the resistance value of one metal electrode is about 0.5 to 2 times the resistance value of the other metal electrode.

Figure 4:
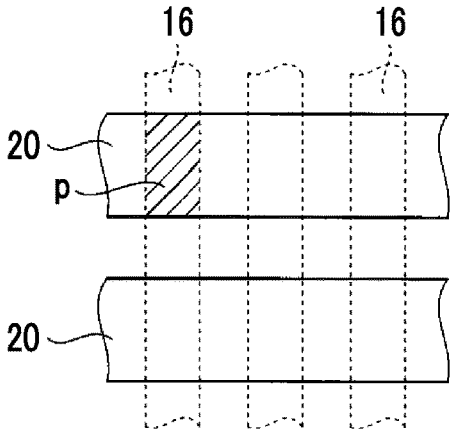
FIG. 4 is a schematic view for illustrating another example of the image forming medium according to the present invention.

Here, in the case in which the shape of the image formation area is rectangular, when the size, thickness, and forming malarias of the first metal electrode 16 and the second metal electrode 20 are the same, the resistance values change. Therefore, in the case in which the shape of the image formation area is rectangular, the metal electrode extending in the same direction as the direction of the long side becomes larger and/or thicker and thus the resistance values of the first metal electrode 16 and the second metal electrode 20 preferably reach the same degree. Accordingly, in this case, as shown in FIG. 4, which will be described later, in the embodiment in which the second metal electrode 20 on the side close to the thermal color developing layer 24 becomes larger, the extending direction of the second metal electrode 20 is preferably made to the long side of the rectangular shape.

In order to make the resistance values of the first metal electrode 16 and the second metal electrode 20 reach the same degree, regarding to the size and thickness of the first metal electrode 16 and the second metal electrode 20, the size and the thickness of one metal electrode are preferably 0.1 to 10 times and more preferably 0.5 to 2 times the size and the thickness of the other metal electrode.

In addition, the interval between the first metal electrodes 16 and the second metal electrodes 20, that is, a pixel pitch, is preferably 1 to 100,000 μm, more preferably 5 to 10,000 μm, and still more preferably 10 to 1,000 μm.

It is preferable that the interval between the first metal electrodes 16 and the second metal electrodes 20 are set to 1 μm or more from the viewpoint of reducing effect on peripheral pixels from heat generation of each pixel and obtaining an image having high sharpness and the like.

It is preferable that the interval between the first metal electrodes 16 and the second metal electrodes 20 is set to 100,000 μm or less from the viewpoint of being capable of forming a high definition image and the like.

The interval between the first metal electrodes 16 and the second metal electrodes 20 refers to a distance between the centers of each metal electrode in the arrangement direction.

Accordingly, it is preferable that the width of the first metal electrodes 16 and the second metal electrodes 20 is set to be appropriate according to the size of the image forming medium 10 so that the interval between the metal electrodes can be set to 1 to 100,000 μm. The width of the first metal electrodes 16 and the second metal electrodes 20 refers to a size of the first metal electrodes 16 and the second metal electrodes 20 in the arrangement direction.

In the present invention, the metal electrode close to the thermal color developing layer 24, that is, as schematically shown in FIG. 4 in the image forming medium 10 shown in the drawing, the second metal electrode 20, is larger than the first metal electrode 16.

That is, in the image forming medium 10 of the present invention, as schematically shown in FIG. 4, the shape of a pixel p formed at the intersection of the first metal electrode 16 and the second metal electrode 20 is preferably a shape narrow in the extending direction of the second metal electrode 20 on the side close to the thermal color developing layer 24.

The heat generated by the second oxide layer 18 is propagated to the second metal electrode 20 to heat the thermal color developing layer 24. Thus, the thermal color developing layer 24 is color-developed. Here, since the second metal electrode 20 is formed of metal, heat is easily propagated. Therefore, the heat generated by the second oxide layer 18 is propagated to the second metal electrode 20 in the extending direction of the second metal electrode 20 and the thermal color developing layer 24 in a region greater than the pixel p in the extending direction is color-developed.

In contrast, when the shape of the pixel p is made to a shape narrow in the extending direction of the second metal electrode 20 on the side close to the thermal color developing layer 24 as shown in FIG. 4, colors are developed in regions other than the pixel p and thus blurring in an image can be suppressed.

As described above, in the image forming medium 10 shown in the drawing, a region of the second oxide layer 18 on the side closer to the first oxide layer 14 than to the second metal electrode 20 functions as a heat generating layer. In other words, the second oxide layer 18 between the second metal electrodes 20 and the first metal electrodes 16 functions as a heat generating layer.

In the image forming medium 10 of the present invention, the thickness of the heat generating layer may be set to be appropriate according to the size and thickness of the image forming medium 10, the formation interval between the metal electrodes, and the like.

According to the investigation of the present inventors, the thickness of the heat generating layer is preferably 0.01 to 1,000 μm, more preferably 0.05 to 100 μm, and still more preferably 0.1 to 10 μm.

It is preferable that the thickness of the heat generating layer is set to 0.01 μm or more from the viewpoint of being capable of reliably preventing short circuit between the first metal electrode 16 and the second metal electrode 20, exhibiting low resistance required for the circuit, and the like.

In addition, it is preferable that the thickness of the heat generating layer is set to 1,000 μm or less from the viewpoint of being capable of reliably applying a current to the heat generating layer at the intersection of the first metal electrode 16 and the second metal electrode 20, obtaining an image forming medium 10 having good flexibility, and the like.

As shown in FIG. 3, the image forming medium 10 is connected to the control unit 34 by the wirings 30 and 32. Specifically, in the image forming medium 10, the first metal electrodes 16 are connected to the control unit 34 by the wirings 30 and the second metal electrodes 20 are connected to the control unit 34 by the wirings 32.

The wirings 30 and 32 electrically connect the first metal electrodes 16 and the second metal electrodes 20 and the control unit 34 by known methods used for various apparatuses using a x-y matrix electrode, such as a touch panel type tablet terminal and a so-called smartphone.

The control unit 34 applies a current to the respective first metal electrodes 16 and second metal electrodes 20 and causes the thermal color developing layer 24 of the image forming medium 10 to be color-developed to form an image.

For example, the control unit 34 is configured to have acquiring means for an image (image date/image information), a control IC (driver) for applying a current to the metal electrodes through the wiring, and the like.

The acquiring means for an image acquires an image by known methods used for information transfer in a wired or wireless manner, such as a method using radio frequency identification (RFID) used for an IC tag and the like, a method using a connector for achieving electric connection with an image supply source such as a tablet terminal, a smartphone, a personal computer, or the like.

Similarly, the control IC applies a current to the respective first metal electrodes 16 and second metal electrodes 20 by a known method using power by wireless power supply used in RFID or power acquired by wired connection.

Hereinafter, an example of the method for producing the image forming medium 10 by the production method of the present invention will be described with reference to FIGS. 5A to 5D.

In FIGS. 5A to 5D, the left side shows cross-sectional views similar to FIG. 2 and the right side shows top views. In addition, in order to show the configuration clearly, similar to FIG. 2, in the cross-sectional views on the left side, only the metal electrodes are hatched and in the top views on the right side of FIGS. 5A to 5D, the metal electrodes are hatched in the same manner.

Figure 5A:
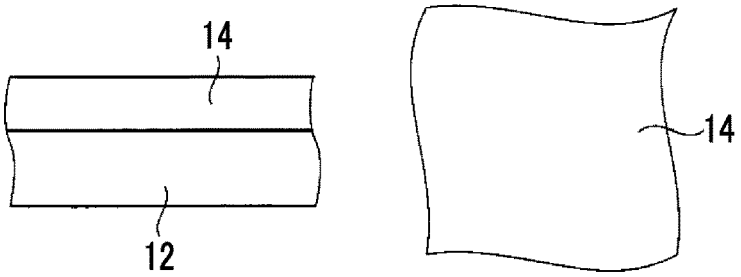
FIGS. 5A to 5D are schematic views for illustrating an example of a method for producing an image forming medium according to the present invention.

First, as shown in FIG. 5A, the first oxide layer 14 is formed on the surface of the substrate 12.

As the method for forming the first oxide layer 14, various known methods can be used according to the material for forming the first oxide layer 14.

Examples thereof include a method of applying and drying an ink containing a metal oxide or a paint obtained by dispersing a metal oxide in a binder. At this time, for the ink or the paint, commercially available products may be used. In addition, a method of forming the first oxide layer 14 on the surface of the substrate 12 by a vapor phase deposition method (gas-phase film forming method), such as sputtering or plasma CVD, can be also used.

Further, the first oxide layer 14 may be formed by preparing a sheet like (plate-like/film-like) metal oxide and attaching the metal oxide to the surface of the substrate 12 by a known method.

Figure 5B:
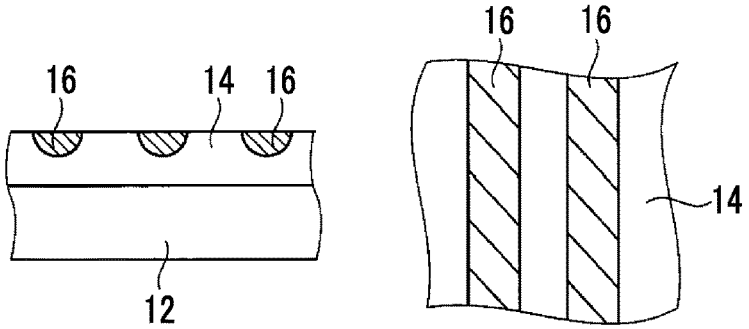

Next, the surface of the first oxide layer 14 is reduced in the form of lines and as shown in FIG. 5B, the plurality of first metal electrodes 16, which are embedded in the first oxide layer 14 such that the first metal electrodes are partially exposed at the surface and extend in one direction, are formed at predetermined intervals.

For the reduction of the first oxide layer 14, various methods can be used. As preferable method, for example, a method of reducing the first oxide layer 14 in the form of lines by irradiation with light to form the first metal electrodes 16 may be used.

For the light irradiation method, known methods may be used. For example, a method of reducing the first oxide layer 14 in the form of lines by scanning exposure by laser light to form the first metal electrodes 16 may be used. In addition, a method of reducing the first oxide layer 14 in the form of lines by an exposure method using reduction projection exposure such as a stepper or a light blocking mask, or an exposure method used in photolithography in the production of a semiconductor, to form the first metal electrodes 16 can be also suitably used.

In the present invention, since the first metal electrodes 16 and the second metal electrodes 20 can be formed by reducing the metal oxides by irradiation with light as described above, highly refined metal electrodes can be easily formed at a low cost with high accuracy.

As described above, an image can be formed on the image forming mediums disclosed in JP1993-278332A (JP-H05-278332A) and JP1996-510067A (JP-H08-510067A) without using a printer or the like. However, it is required to form electrodes in a matrix form in the image forming mediums disclosed in JP1993-278332A (JP-H05-278332A) and JP1996-510067A (JP-H08-510067A) by vapor deposition or printing using a conductive material such as metal or the like.

In contrast, since a matrix-shaped electrode can be formed in the image forming medium of the present invention by irradiation with light, the matrix-shaped electrode can be easily formed at a low cost. In addition, since the electrode can be formed by scanning or projection exposure by laser light, a highly refined electrode can be formed with high accuracy.

Figure 5C:
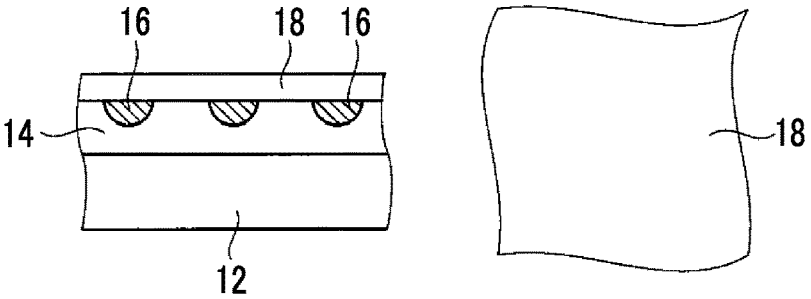

Next, as shown in FIG. 5C, the second oxide layer 18 is formed on the first oxide layer 14 on which the first metal electrodes 16 are formed. The second oxide layer 18 may be formed in the same manner as the formation of the first oxide layer 14.

Figure 5D:
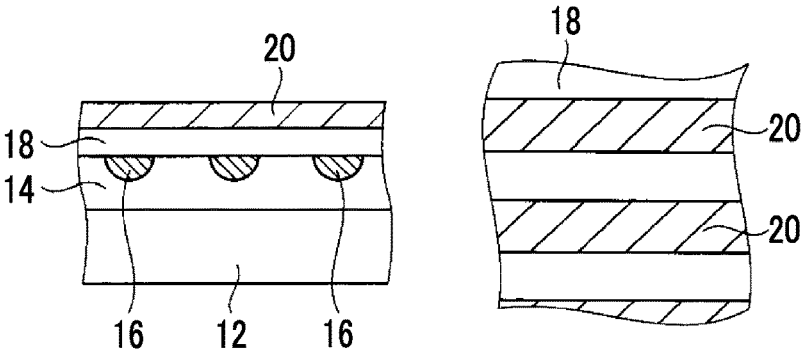

Next, as shown in FIG. 5D, the surface of the second oxide layer 18 is reduced in the form of lines perpendicular to the first metal electrodes 16 and the second metal electrodes 20 which are embedded in the second oxide layer 18 such that the second metal electrodes are partially exposed at the surface and extend in a direction perpendicular to the first metal electrodes 16 are formed at predetermined intervals. The second metal electrodes 20 may be formed in the same manner as the formation of the first metal electrodes 16.

Further, as shown in FIG. 2, the thermal color developing layer 24 is attached to the second oxide layer 18 on which the second metal electrodes 20 are formed to prepare the image forming medium 10. The thermal color developing layer 24 may be attached by a known method.

The image forming medium 10 shown in FIG. 1 and the like has the first metal electrodes 16 which are embedded in the first oxide layer 14 and the second metal electrodes 20 which are embedded in the second oxide layer 18 different from the first oxide layer 14.

However, the present invention can adopt various configurations in addition to this configuration.

Figure 6:
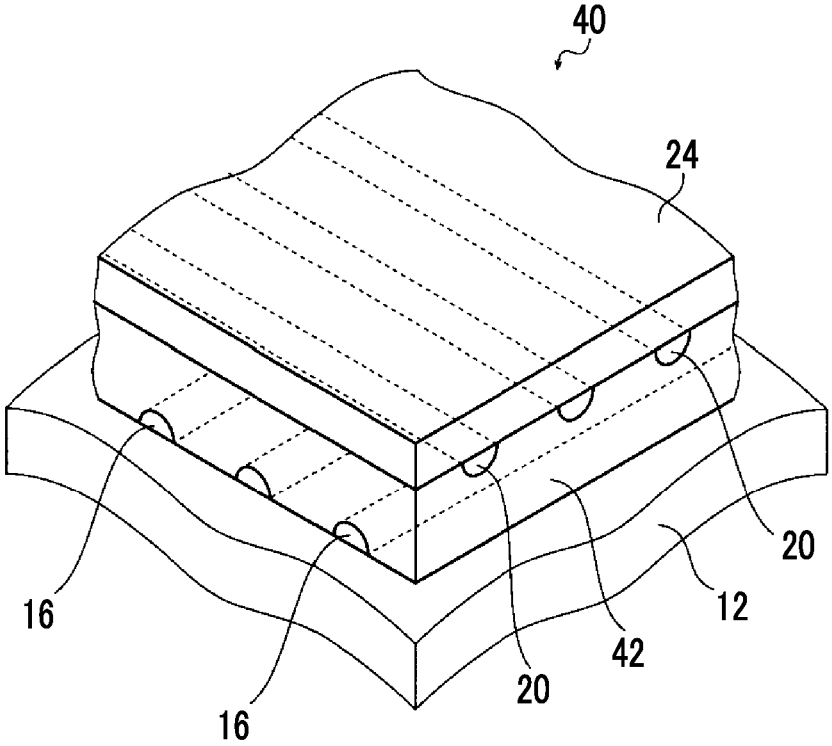
FIG. 6 is a schematic perspective view for illustrating another example of the image forming medium according to the present invention.

FIG. 6 schematically shows an example thereof. In an image forming medium 40 shown in FIG. 6, the same members as in the image forming medium 10 shown in FIG. 1 and the like are mainly used. Thus, the same reference numerals are assigned to the same members and in the following description, different points will be mainly described.

The image forming medium 40 shown in FIG. 6 is configured to basically have a substrate 12, a metal oxide layer 42, first metal electrodes 16, second metal electrodes 20, and a thermal color developing layer 24.

In the image forming medium 40, the first metal electrodes 16 and the second metal electrodes 20 are formed on one metal oxide layer 42 to be perpendicular to one another.

That is, a plurality of first metal electrodes 16, which extend in one direction and are embedded in the surface side of the metal oxide layer 42 such that the first metal electrodes are partially exposed at one surface of the metal oxide layer 42, are provided at predetermined intervals. In addition, a plurality of second metal electrodes 20, which extend in a direction perpendicular to the first metal electrodes 16 and are embedded in the surface side of the metal oxide layer 42 such that the second metal electrodes are partially exposed at the other surface of the metal oxide layer 42, are provided at predetermined intervals.

Accordingly, in the image forming medium 40, a region between the first metal electrodes 16 and the second metal electrodes 20 in the metal oxide layer 42 functions as a heat generating layer (heat generating resistance layer).

Such an image forming medium 40 can be basically prepared in the same manner as in the formation of the image forming medium 10 shown in FIG. 1 and the like.

That is, the sheet-like metal oxide layer 42 is prepared and one surface thereof is reduced in the form of lines. Thus, the first metal electrodes 16 which extend in one direction and are embedded in the metal oxide layer 42 can be formed at predetermined intervals.

Next, the other surface of the metal oxide layer 42 is reduced in the form of lines extending in the direction perpendicular to the first metal electrodes 16 and thus the second metal electrodes 20 which extend in the direction perpendicular to the first metal electrodes 16 and are embedded in the metal oxide layer 42 are formed at predetermined intervals.

Next, the metal oxide layer 42 on which the first metal electrodes 16 and the second metal electrodes 20 are formed is attached to the substrate 12.

Further, the thermal color developing layer 24 is attached to the surface of the metal oxide layer 42 on the opposite side of the substrate 12 to prepare the image forming medium 40.

The image forming medium, the method for producing an image forming medium, and the image forming method according to the present invention have been described in detail above. However, the present invention is not limited to the above-described examples and it is needless to say that various modifications and changes may be made within a range not departing from the spirit of the present invention.

Examples

Hereinafter, the image forming medium and the method for producing an image forming medium according to the present invention will be described in more detail by reference to specific examples of the present invention.

Examples

According to the method shown in FIGS. 5A to 5D, the image forming medium 10 shown in FIGS. 1 and 2 was prepared.

The substrate 12 made of polyimide was prepared.

A copper oxide ink (manufactured by NovaCentrix) was applied to the surface of the substrate 12 by blade coating and dried to form the first oxide layer 14 having a thickness of 20 μm on the surface of the substrate as shown in FIG. 5A.

The first oxide layer 14 was subjected to scanning exposure by a laser beam to reduce a copper oxide for forming the first oxide layer 14 and the first metal electrodes 16 made of copper extending in one direction were formed as shown in FIG. 5B. The first metal electrodes 16 had a width of 0.2 mm, an interval of 0.4 mm and a thickness of about 18 μm.

The same copper oxide ink was applied to on the surface of the first oxide layer 14 on which the first metal electrodes 16 were formed and dried to form the second oxide layer 18 having a thickness of 20 μm as shown in FIG. 5C.

The second oxide layer 18 was subjected to scanning exposure by a laser beam to reduce a copper oxide for forming the second oxide layer 18 and the second metal electrodes 20 made of copper extending in a direction perpendicular to the first metal electrodes 16 were formed as shown in FIG. 5D. The second metal electrodes had a width of 0.2 mm, an interval of 0.4 mm, and a thickness of about 18 μm. Accordingly, a region in which the second metal electrode 20 is not formed and the thickness is 2 μm in the second oxide layer 18 functions as a heat generating layer.

Further, normal thermal paper was attached to the second oxide layer 18 on which the second metal electrodes 20 were formed as the thermal color developing layer 24 to prepare the image forming medium 10 shown in FIGS. 1 and 2.

An arbitrary image pattern was assumed and a current was sequentially applied to the first metal electrodes 16 and the second metal electrodes 20 of the pixels corresponding to the image pattern in the prepared image forming medium 10.

As a result, the assumed image pattern could be formed on the thermal color developing layer 24.

From the above results, the effect of the present invention becomes apparent.

INDUSTRIAL APPLICABILITY

The image forming medium can be suitably used for various applications requiring the preparation of a simple print.

EXPLANATION OF REFERENCES

10, 40: image forming medium
12: substrate
14: first oxide layer
16: first metal electrode
18: second oxide layer
20: second metal electrode
24: thermal color developing layer
30, 32: wirings
42: metal oxide layer

What is claimed is:

1. An image forming medium comprising:
a plurality of first metal electrodes which extend in one direction and are parallel to one another;
a first oxide layer in which the first metal electrodes are embedded and which is made of an oxide of a metal constituting the first metal electrodes;
a plurality of second metal electrodes which extend in one direction, are parallel to one another, and cross the first metal electrodes in a surface direction of the first oxide layer;
a second oxide layer in which the second metal electrodes are embedded and which is made of an oxide of a metal constituting the second metal electrodes;
a thermal color developing layer which is provided on the first metal electrodes or the second metal electrodes; and
a substrate which sandwiches the first oxide layer and the second oxide layer with the thermal color developing layer,
wherein the second metal electrodes are separated from the first metal electrodes by the second oxide layer.

2. The image forming medium according to claim 1, wherein the metal electrode on which the thermal color developing layer is provided is thicker than the other metal electrode.

3. The image forming medium according to claim 1, wherein the thermal color developing layer is provided to be in direct contact with the first metal electrodes or the second metal electrodes.

4. The image forming medium according to claim 1, wherein a resistance value of the second oxide layer is 2 to 1,000,000 times resistance values of the first metal electrode and the second metal electrode.

5. The image forming medium according to claim 1, wherein a thickness of the second oxide layer at a region between the first metal electrode and the second metal electrode is 0.01 to 1,000 μm.

6. The image forming medium according to claim 1, wherein a thickness of the second oxide layer is 0.02 to 2,000 μm.

7. The image forming medium according to claim 1, wherein a resistance value of one metal electrode of the first metal electrode and the second metal electrode is 0.5 to 2 times a resistance value of the other metal electrode.

8. An image forming method comprising:

sequentially applying a current to the first metal electrodes and the second metal electrodes of the image forming medium according to claim 1 based on an image to be formed and generating heat at regions between the first metal electrodes and the second metal electrodes in the second oxide layer to color-develop the thermal color developing layer.

9. An image forming medium comprising:

a plurality of first metal electrodes which extend in one direction and are parallel to one another;

an oxide layer in a surface of which the first metal electrodes are embedded;

a plurality of second metal electrodes which extend in one direction, are parallel to one another, cross the first metal electrodes in a surface direction of the oxide layer, and are embedded in an opposite surface of the oxide layer from the surface in which the first metal electrodes are embedded;

a thermal color developing layer which is provided on the first metal electrodes or the second metal electrodes; and a substrate which sandwiches the oxide layer with the thermal color developing layer, wherein the second metal electrodes are separated from the first metal electrodes by the oxide layer, and wherein the oxide layer is made of an oxide of a metal constituting the first metal electrodes and the second metal electrodes.

10. A method for producing an image forming medium comprising:

a step of forming a first oxide layer on one surface of a substrate;

a step of forming a plurality of first metal electrodes, which extend in one direction and are parallel to one another, on a surface of the first oxide layer by reducing the metal oxide;

a step of forming a second oxide layer, which is made of a metal oxide, on the surface of the first oxide layer on which the first metal electrodes are formed;

a step of forming a plurality of second metal electrodes, which extend in one direction, are parallel to one another, and cross the first metal electrodes in a surface direction of the second oxide layer, on a surface of the second oxide layer by reducing the metal oxide; and a step of providing a thermal color developing layer on the surface of the second oxide layer.

11. The method for producing an image forming medium according to claim 10, wherein in the formation of the first metal electrodes and the second metal electrodes, the second metal electrodes are formed to be thicker than the first metal electrodes.

12. The method for producing an image forming medium according to claim 10, wherein the metal oxide is reduced by irradiation with light.

13. A method for producing an image forming medium comprising:

a step of forming a plurality of first metal electrodes, which extend in one direction and are parallel to one another, on one surface of an oxide layer made of a metal oxide by reducing the metal oxide;

a step of forming a plurality of second metal electrodes, which extend in one direction, are parallel to one another, and cross the first metal electrodes in a surface direction of the oxide layer, on a surface of the oxide layer on the opposite side of the surface on which the first metal electrodes are formed by reducing the metal oxide;

a step of attaching a substrate on one surface of the oxide layer on which the first metal electrodes and the second metal electrodes are formed; and a step of providing a thermal color developing layer on an opposite surface from the substrate of the oxide layer.

14. The method for producing an image forming medium according to claim 13, wherein the metal oxide is reduced by irradiation with light.

15. The method for producing an image forming medium according to claim 13, wherein in the formation of the first metal electrodes and the second metal electrodes, a metal electrode on the side close to the thermal color developing layer is formed to be thicker than the other metal electrode.

* * * * *